US005416453A

United States Patent [19]

Quan

[11] Patent Number: 5,416,453

[45] Date of Patent: May 16, 1995

[54] COAXIAL-TO-MICROSTRIP ORTHOGONAL LAUNCHERS HAVING TROUGHLINE CONVERTORS

[75] Inventor: Clifton Quan, Arcadia, Calif.

[73] Assignee: Hughes Aircraft Company, Los Angeles, Calif.

[21] Appl. No.: 415,003

[22] Filed: Sep. 29, 1989

[51] Int. Cl.[6] ..... H01P 5/08; H01P 5/12

[52] U.S. Cl. ..... 333/127; 333/33; 333/128

[58] Field of Search ..... 333/33, 246, 260, 127, 333/128

[56] References Cited

U.S. PATENT DOCUMENTS

| | | | |
|---|---|---|---|
| 3,496,492 | 2/1970 | Kurzl et al. | 333/116 |
| 4,143,342 | 3/1979 | Cain et al. | 333/246 X |
| 4,346,355 | 8/1982 | Tsukii | 333/33 |
| 4,810,981 | 3/1989 | Herstein | 333/33 X |
| 4,951,011 | 8/1990 | Heckaman et al. | 333/33 |

FOREIGN PATENT DOCUMENTS

| | | | |
|---|---|---|---|
| 3724945 | 2/1989 | Germany | 333/26 |
| 85103 | 6/1980 | Japan | 333/33 |
| 91503 | 7/1981 | Japan | 333/33 |
| 174801 | 8/1986 | Japan | 333/260 |

OTHER PUBLICATIONS

Semiconductor Control by Joseph White; copyright 1977 by Artech House Inc., Dedham Mass.; pp. 515–518.

*Primary Examiner*—Eugene R. Laroche
*Assistant Examiner*—Benny T. Lee

[57] ABSTRACT

An orthogonal coaxial-line-to-microstripline transition is described. The transition employs capacitively loaded troughline transmission line to interface between the coaxial line and the microstripline. Because the field configuration of the troughline shows similarities to both the coaxial line and the microstripline configurations, a well matched transition between coaxial line onto microstripline. The center conductor of the troughline can be bent at right angles with no mismatch. Dielectrically loading the troughline prevents higher order modes from radiating out of the trough.

9 Claims, 2 Drawing Sheets

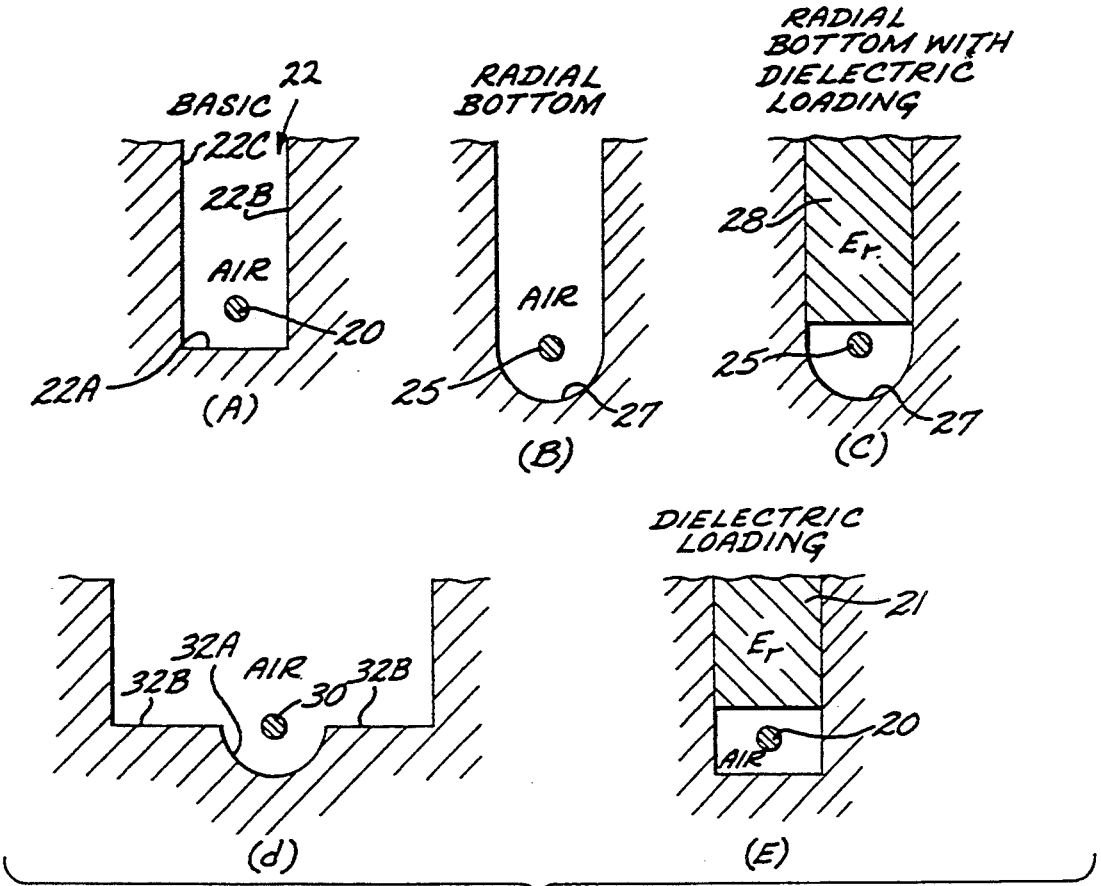
FIG. 1
FIG. 2
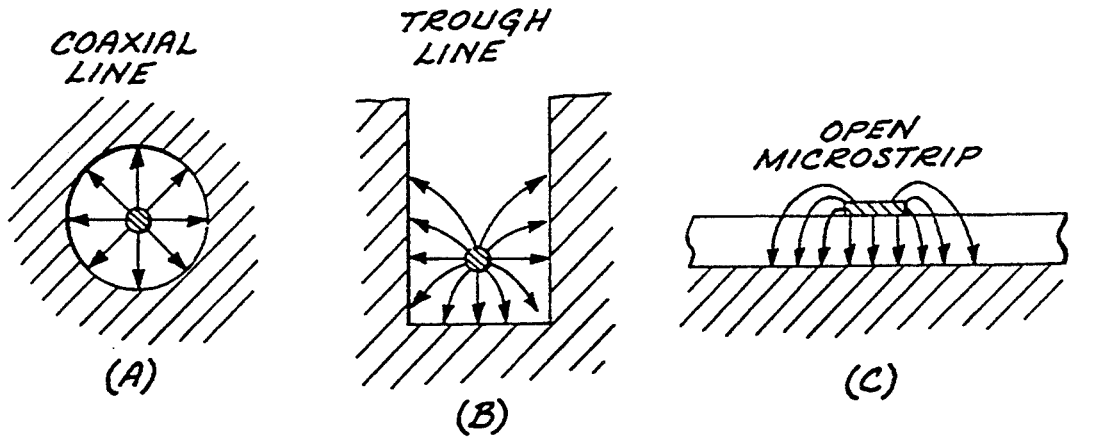

COAXIAL-TO-MICROSTRIP ORTHOGONAL LAUNCHERS HAVING TROUGHLINE CONVERTORS

BACKGROUND OF THE INVENTION

The present invention relates to devices for conveying microwave frequency energy between coaxial and microstripline transmission media, and more particularly to orthogonal coaxial-to-microstripline launchers.

In some applications, such as active array antennas and communication satellite systems, it is desirable to integrate coaxial lines to the microstripline medium, typically between microwave integrated circuit (MIC) packages. Such interfaces have in the past been made by right angle coaxial connectors or direct coaxial-to-microstripline right angle junctions. Right angle coaxial connectors are not well matched at X-band frequencies (VSWR greater than 1.25:1), and can be attached only along the sides of the MIC packages.

The direct coaxial-to-microstripline right angle junction is characterized by narrow band performance, and the attachment to the MIC package is potentially blind if routed through the top cover of the package. Moreover, higher order modes can radiate when the connection is routed through the air space of the microstripline. The mechanical assembly of a direct right angle junction is typically difficult and, further, it is difficult to rework the junction or perform RF tuning after the assembly is made.

It is therefore an object of the present invention to provide a compact microstrip feed network, permitting an extra degree of freedom in being able to locate the RF interfaces along the top and bottom faces of a MIC package as well as its sides.

SUMMARY OF THE INVENTION

A coaxial-to-microstrip orthogonal launcher is disclosed for transitioning between orthogonal coaxial and microstrip transmission lines in a microwave circuit. The launcher includes a troughline transmission line comprising a conductive structure defining a trough, and a trough conductor supported within the trough. The trough conductor has first and second ends, the first end making electrical contact with the center conductor of the coaxial line, and the second end making electrical contact with the conductor strip of the microstrip transmission line. The trough conductor defines a substantially 90° angle between its first and second ends.

The troughline is capacitively loaded by a dielectric load element to prevent higher order modes from propagating out of the trough. Because the electromagnetic field configuration of troughline shows similarities to the field configurations of a coaxial line and a microstripline, a well-matched transition between coaxial line and microstrip is obtained.

BRIEF DESCRIPTION OF THE DRAWINGS

These and other features and advantages of the present invention will become more apparent from the following detailed description of an exemplary embodiment thereof, as illustrated in the accompanying drawings, in which:

FIG. 1 illustrates the electromagnetic field configurations of five different troughline configurations.

FIG. 2 illustrate the electromagnetic field configurations of respective coaxial line, troughline and open microstripline transmission media.

DETAILED DESCRIPTION OF THE PREFERRED EMBODIMENTS

Figure 4:
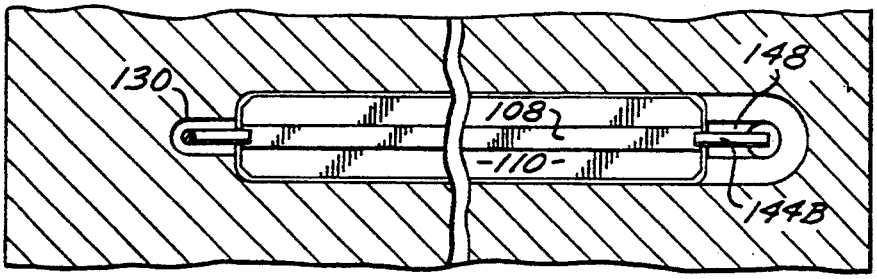
FIG. 4 is a partial top cross-sectional view of the transition structure of FIG. 3, taken along line 4—4 of FIG. 3.

The invention comprises an orthogonal coaxial-to-microstrip launcher or transition. The launcher employs a capacitively loaded troughline transmission line to interface the coaxial and microstrip lines. Troughline transmission line is described in "Semiconductor Control," Joseph F. White, Artech House, Inc., 1977, pages 516–518. FIGS. 1A–1E show cross-sections of various exemplary troughline configurations. FIG. 1A shows a troughline comprising a troughline conductor 20 supported in air within a conductive trough structure 22 having a flat bottom surface 22A and upright sides 22B and 22C. FIG. 1B shows a troughline comprising a troughline conductor 25 supported in air within a conductive troughline structure having a radial bottom 27. FIG. 1C shows the same troughline as in FIG. 1B, except that the open region within the trough structure is filled with a dielectric material 28 of dielectric constant $E_r$ to provide dielectric loading. FIG. 1D shows a troughline configuration wherein the troughline conductor 30 is supported in air above the bottom of the troughline structure which comprises a radiused portion 32A and flat portions 32B. FIG. 1E shows a troughline configuration like that of FIG. 1A except that a portion of the open region above the conductor 20 within the trough structure is filled with a dielectric material 21 having a dielectric constant $E_r$ to provide dielectric loading.

Troughline is chosen in accordance with the invention to act as an intermediary between the coaxial line and the microstripline because its field configuration shows similarities to both transmission lines, as illustrated in FIGS. 2A–2C. FIG. 2A illustrates a cross-section of a coaxial transmission line and its electromagnetic field configuration. FIG. 2B illustrates a cross-section of a troughline configuration (similar to that of FIG. 1A) and its electromagnetic field configuration. FIG. 2C illustrates a cross-section of an open microstrip and its electromagnetic field configuration. As a result of the similarity in the electromagnetic field configurations, using troughline helps to realize a well matched transition from the coaxial line onto microstripline. The center conductor of the troughline can bend at right angles with no mismatch. Dielectrically loading the troughline prevents higher order waveguide modes (than the TEM mode) from radiating out of the trough.

The open structure of the troughline allows easy access for assemblying, testing and tuning a microwave integrated circuit (MIC) without the presence of the top cover of the MIC package.

Figure 3:
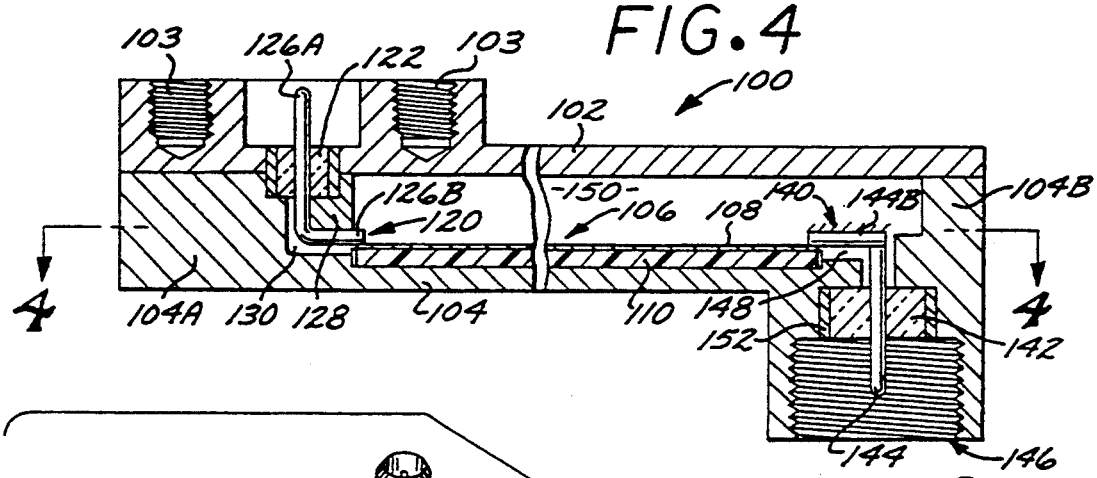
FIG. 3 is a partial side a cross-sectional view of an orthogonal coaxial line-to-microstripline transition structure in accordance with the invention.

FIGS. 3 and 4 disclose an exemplary planar microstripline circuit package 100 employing a top cover orthogonal launcher 120 and a bottom plane orthogonal launcher 140 in accordance with the invention. The circuit package 100 includes a removable top cover 102 a, bottom ground plane 104, and a microstrip transmission circuit 106 generally comprising microstrip conductor 108 and microstrip substrate 110. An open channel is machined or molded into the conductive ground plane structure 104, and accepts the microstrip substrate 110 and conductor 108 as shown in FIG. 3. An air dielectric region 150 is defined between the upper surface of the substrate 110 and the top cover 102. One end 104A of the ground plane structure 104 defines the trough 130 of the top cover launcher 120, and defines an upwardly facing circular opening for receiving a coaxial feedthrough 122. The other end 104B of the ground plane structure 104 defines the trough 148 of the ground plane launcher 140, and defines a downwardly facing circular opening 152 for receiving the coaxial feedthrough 142.

The top cover launcher 120 employs the coaxial feedthrough 122 whose center pin 126A is bent at a right angle to form the trough line center conductor 126B. The trough line conductor 126B is mounted in the trough line channel 130, and is connected (via solder connection) to the conductor strip 108 of the microstrip circuit 106. A plug 128 of a high dielectric material is fitted into the trough channel 130 to capacitively load the troughline, thereby preventing higher order modes from propagating out of the trough 130 into the air dielectric region 150. The troughline for the top cover launcher is of the configuration shown in FIG. 1(*c*).

A coaxial connection can be made to the launcher 120 by a coaxial-to-coaxial connector (not shown) fastened to the top cover 120 via threaded openings 103, or via a screw-in coaxial connector (not shown), or by other conventional means.

The bottom ground plane orthogonal launcher 140 comprises a coaxial feedthrough device comprising dielectric element 142 and pin 144. The coaxial feedthrough device first transitions between the air dielectric coaxial line generally indicated by reference numeral 146, then into a capacitively loaded troughline of the configuration shown in FIG. 1(*d*), and subsequently into the microstrip line 106. Here again, the end 144B of the center conductor 144 is bent to form the troughline conductor, and is electrically connected to the microstripline conductor 108 (via a solder connection). A separate dielectric plug (similar to plug 128) is not required for the bottom plate launcher, since the trough conductor extends upwardly from the bottom plate, and does not extend significantly into the air dielectric region 150.

The orthogonal coaxial-to-microstrip launchers described above allow the microwave circuit designer additional flexibility in the design of compact MIC packages operating, for example, at X-band. The launchers can be designed to have a maximum VSWR, for example, of 1.10:1 when measured from 6 GHz to 12 GHz. Moreover, the launchers are readily accessible for assembly or RF tuning.

Figure 5:
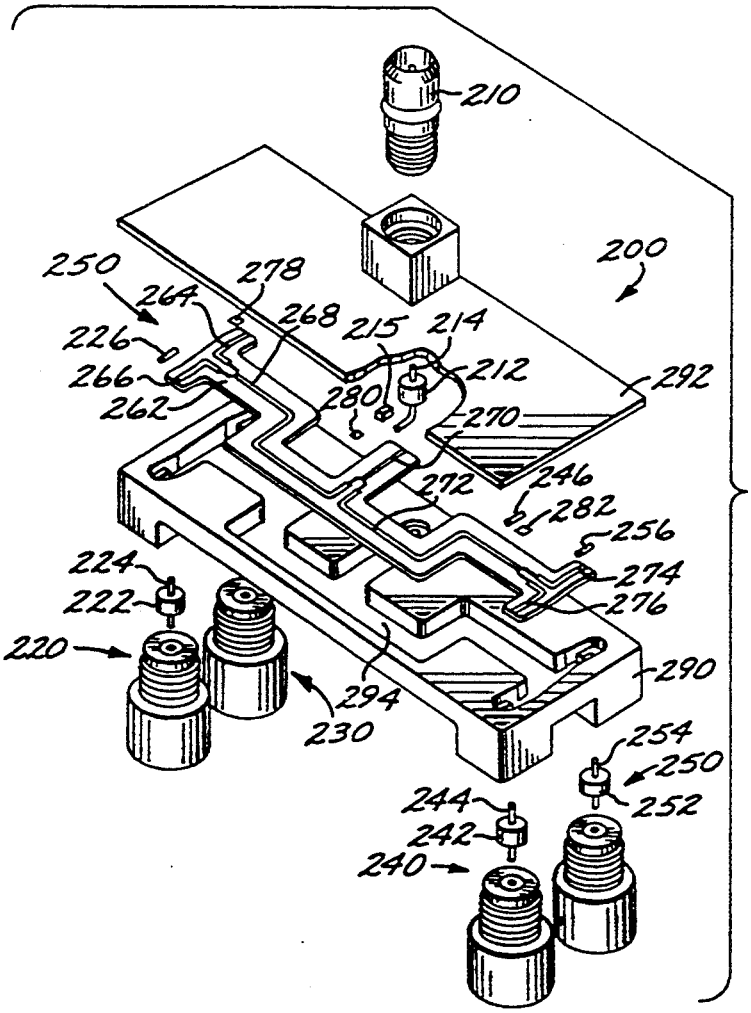
FIG. 5 is an exploded perspective view illustrative of a four-way microstripline power divider assembly with orthogonal launchers in accordance with the invention.

FIG. 5 is an exploded perspective view showing how the orthogonal coaxial to microstripline launchers are assembled into an exemplary four-way power divider circuit 200 used for active arrays. In this circuit, the input signal is provided via coaxial OSP plug connector device 210, and is divided into four signals which are output from the device 200 via the respective coaxial OSP connector jacks 220, 230, 240 and 250. The OSP plug 210 may comprise, for example, a type 55575328-02 marketed by Omni Spectra, 21 Continental Blvd., Merrimack, N.H. 03054. The OSP jacks may comprise, for example, a type 45585328-02 connector jack marketed by Omni Spectra. Each of these coaxial connectors mate to coaxial line structures which comprise a dielectric feedthrough seal element (elements 212, 222, 242 and 252 are visible in FIG. 5) and a center conductor (conductors 214, 224, 244 and 254 are visible in FIG. 5). The center conductor 214 is bent at right angles to form the troughline conductor for the top cover launcher. The top cover launcher includes a dielectric plug 215. Pieces 226, 246 and 256 of copper wire are joined at right angles to the tips of the conductors 224, 244 and 254 to from the troughline conductors for the bottom cover launchers. Another piece of copper wire (not visible in FIG. 5) is joined at a right angle to the tip of the conductor (not visible in FIG. 5) for the connector jack 230.

The circuit 200 further comprise a microstripline circuit 250 comprising the dielectric substrate 262, conductor strips 264, 266, 268, 270, 272, 274, 276, and 100 ohm chip resistor elements 278, 280 and 282. Resistor 278 connects conductor strips 264, 266 and 268. Resistor 280 connects conductor strips 268, 270 and 272. Resistor 282 connects conductor strips 272, 274 and 276. The microstripline divider circuit 250 is itself well known in the art.

The circuit 200 further comprises a conductive housing 290 and top plate 292. A channel 294 is defined in the housing 290 in the configuration of the microstripline substrate 252 so that the substrate 252 may be received within the channel 294.

It is understood that the above-described embodiments are merely illustrative of the possible specific embodiments which may represent principles of the present invention. Other arrangements may readily be devised in accordance with these principles by those skilled in the art without departing from the scope of the invention.

What is claimed is:

1. A microwave circuit, comprising:

a planar microstripline circuit comprising a substrate and a microstripline conductor disposed on a top surface of said substrate:

a ground plane structure comprising means for defining a ground plane for the microstripline circuit;

a conductive top cover member, the ground plane structure and said top cover member defining an enclosure for said microstripline circuit, and wherein an air dielectric region is defined between said microstripline circuit and said too cover member;

a top cover coaxial-to-microstripline orthogonal launcher dispersed in said top cover member with a top cover coaxial port extending substantially orthogonal to said microstripline circuit, said launcher comprising a first troughline transmission line comprising a first conductive structure defining an open trough having parallel sides which are substantially perpendicular to said top surface of said microstripline substrate, and a first troughline conductor having first and second ends, the first end making electrical contract with the microstripline conductor, the second end making electrical contact with the top cover coaxial port, said troughline conductor defining a substantially 90° angle between its first and second ends, and a capacitive dielectric load element disposed in a portion of said trough between said trough conductor element and said air region for capacitively loading the troughline transmission line to prevent higher order modes from radiating out of said trough into said air dielectric region; and bottom plane coaxial-to-microstripline orthogonal launcher disposed in said ground plane with a bottom plane coaxial port extending substantially orthogonal to said microstripline circuit, said bottom plane launcher comprising a second troughline transmission line comprising a second conductive structure defining an open trough, and a second trough conductor element disposed in the open trough, the second trough conductor element having first and second ends, the first end of the second trough conductor element extending through and electrically contacting a bottom plane structure coaxial port opening, the second end of the second trough conductor element making electrical contact with said microstripline conductor.

2. The microwave circuit of claim 1 wherein said ground plane structure is characterized by an open channel formed therein for receiving the microstripline circuit, and said ground plane structure further comprises means for defining said respective first and second troughs adjacent said microstripline circuit.

3. The microwave circuit of claim 1 further characterized by a plurality of said bottom plane orthogonal launchers, and in that said microwave circuit comprises means for dividing input RF power applied at said top cover coaxial port between said bottom plane coaxial ports.

4. The microwave circuit of claim 1 wherein said capacitive load element comprises a dielectric load disposed in a portion of said first trough adjacent said trough conductor element.

5. In a microwave circuit comprising a planar microstripline circuit characterized by a substrate and microstripline conductor on a top surface of said substrate, with a dielectric air region formed above said top surface, and a coaxial line having a conductor element extending along a center axis disposed orthogonally to said microstripline from the microstripline conductor of the microstripline circuit, a top-side coaxial-to-microstripline orthogonal launcher comprising a troughline transmission line comprising a conductive structure defining an open trough having parallel sides which extends substantially perpendicular to said top surface of said substrate, and a trough conductor element having first and second ends, the first end making electrical contact with said coaxial conductor element, the second end making electrical contact with the microstrip conductor, said troughline conductor defining a substantially 90° angle between its first and second ends, and a capacitive dielectric load element disposed in a portion of said trough between said trough conductor element and said air region for capacitively loading the troughline transmission line to prevent higher order modes from radiating out of the trough to said air region above said microstripline conductor.

6. The orthogonal launcher of claim 5 wherein said microwave circuit is further characterized by a conductive ground plane structure and a conductive top cover member, said dielectric air region formed between said top cover member and said top surface of said microstripline circuit, said ground plane structure defining a ground plane for said microstripline circuit.

7. The orthogonal launcher of claim 6 wherein said launcher is disposed as a top cover orthogonal launcher communicating between a top cover coaxial port comprising said coaxial conductor element and extending substantially orthogonal to said microstripline circuit and said microstripline conductor.

8. The orthogonal launcher of claim 7 wherein said ground plane structure is characterized by an open channel formed therein for receiving the microstripline substrate, whereby an air dielectric region is defined between said microstripline substrate and said top cover plate.

9. The orthogonal launcher of claim 8 wherein said ground plane structure further comprises means for defining said trough for said top cover orthogonal launcher adjacent said channel.

* * * * *